United States Patent [19]

Brinkhaus et al.

[11] 4,197,659

[45] Apr. 15, 1980

[54] DEVICE FOR DRYING TEXTILE WEBS

[75] Inventors: Wolfgang Brinkhaus, Hamburg; Alfred Schraud, Seevetal, both of Fed. Rep. of Germany

[73] Assignee: Artos Dr.-Ing. Meierwindhorst KG (GmbH & Co.), Seevetal, Fed. Rep. of Germany

[21] Appl. No.: 877,451

[22] Filed: Feb. 13, 1978

[30] Foreign Application Priority Data

Feb. 11, 1977 [DE] Fed. Rep. of Germany ..... 2705760

[51] Int. Cl.[2] ..... F26B 13/00

[52] U.S. Cl. ..... 34/155; 34/160; 432/59; 432/152

[58] Field of Search ..... 34/155, 82, 156, 160; 432/59, 144, 152

[56] References Cited

U.S. PATENT DOCUMENTS

| | | | |
|---|---|---|---|
| 1,976,509 | 10/1934 | Olsen | 34/82 |
| 2,499,572 | 3/1950 | Duhakin et al. | 34/156 X |
| 3,429,057 | 2/1969 | Thygeson, Sr. | 34/160 |
| 3,874,091 | 4/1975 | Fukumoto | 34/160 X |
| 4,094,077 | 6/1978 | Schrader et al. | 34/155 |

FOREIGN PATENT DOCUMENTS

| | | | |
|---|---|---|---|
| 531073 | 7/1955 | Italy | 34/160 |

*Primary Examiner*—John J. Camby
*Assistant Examiner*—Harold Joyce
*Attorney, Agent, or Firm*—Allison C. Collard; Thomas M. Galgano

[57] ABSTRACT

A device is provided for drying wide textile webs, and the like, by means of a circulating, heated, gas-like treatment medium which is blown laterally across the web of material by means of jet nozzle elements having upper and lower fingers which are symmetrically arranged with respect to the web of material and extend over the total width of the textile web. The fingers of each nozzle element are provided with one common inlet opening for charging the treatment medium, and the openings for the jet nozzles are alternatively positioned on one side, and on the other side of the web, so as to ensure an even distribution of the treatment medium over the total face of the textile web, after which, the treatment medium flows off the side of the web opposite the common inlet opening. The device is characterized by arranging the inlet openings of the jet nozzle elements in alternate pairs at opposite sides of the web, and by providing a common return flow chamber for the return flow of the treatment medium which is arranged opposite from and in downflow direction from the inlet openings for the jet nozzle elements.

4 Claims, 3 Drawing Figures

PRIOR ART

DEVICE FOR DRYING TEXTILE WEBS

The present invention relates to a device for drying wide textile webs, and the like. More particularly, it relates to such a device wherein drying is effected by means of a circulating, heated, gas-like treatment medium which is blown onto the web of textile material laterally thereacross by means of upper and lower jet nozzles which extend over the total width of the textile web and which are provided with one common inlet opening for introducing or charging the treatment medium. The openings for the jet nozzles are alternately postioned on one side of the lateral web edge and on the other side of the lateral web edge, so as to ensure an even distribution of the treatment medium over the total face of the textile web and after the treatment process, the medium flows off to the opposite side of the web remote from the common inlet opening.

It has been previously proposed to provide a device for drying a continuously moving web of material by means of a gas-like treatment medium. In these known devices, blower nozzles are provided which include a housing on which are mounted a plurality of so-called jet fingers. The treatment medium is guided in a circulatory system by means of blowers into the jet fingers and onto the web of material and from the web of material back through the jet fingers, to lint filters and heating elements and subsequently back to the blowers where the circulatory path starts again.

Generally speaking, the blowers are arranged laterally with respect to the web of material. However, since the blowers are arranged only at one side of the web material, it is impossible to obtain a symmetrical application of the treatment medium over the total width thereof, as a result of which certain unevenness in the treatment occurs.

In order to prevent such an unevenness of the treatment, it has been previously suggested to arrange the jet housings in alternate positions at both sides of the web of material; i.e., the successive jet housings with their associated blowers, are reversely arranged (turned by about 180°). In order to obtain a more even distribution of the treatment medium, the treatment medium was fed in a manner such that the treatment medium fow path of adjacent jet housings overlapped (see German Laid Open Pat. No. 1,064,464).

These prior art drying devices operate in an adequate manner and achieve even treatment over the total width of the web material. However, these known devices are very expensive because they require a large number of heating elements for heating the treatment medium. In the prior art devices, four heating elements are required for heating the treatment medium at each so-called "drying field" which always consisted of two adjacent reversely positioned (turned) by 180°) jet housings. Moreover, the direct heating by oil burners is disadvantageous because the capacity of each burner is relatively low. Hence, these burners generally do not operate sufficiently. Furthermore, the technical construction of the burners, control elements, etc., requires a lot of work and is expensive.

It is, therefore, an object of the present invention to overcome the aforementioned disadvantages, i.e., the economics for heating the treatment medium should be increased by increasing the efficiency of the heating elements. Furthermore, the structure of the dryer should be simplified and, therefore, be more economical.

In order to achieve this object of the invention in a device for drying wide textile webs of the above mentioned type, the inlet openings of the jet nozzle elements are arranged in pairs alternately at one side and the other side of the web of material, and the spaces for returning the treatment medium are concentrated or combined and are preferably positioned underneath the treatment and discharge chamber, opposite from the jet nozzle inlet openings for the treatment medium. It has been shown that it is advantageous to arrange the heating elements and the lint filters for the treatment medium in the common return chambers.

It is also advantageous to use open flame heating elements in open burn chambers and to provide one individual burn chamber for two adjacent jet nozzle elements in the common return chamber.

In a further embodiment of the invention, the lint filters should be annular filters which makes an observation of the material possible.

Other objects and features of the present invention will become apparent from the following detailed description when taken in connection with the accompanying drawing which discloses a single embodiment of the invention. It is to be understood that the drawing is designed for the purpose of illustration only, and is not intended as a definition of the limits and scope of the invention disclosed.

In the drawing, wherein similar reference numerals denote similar elements throughout the several views.

Figure 1:
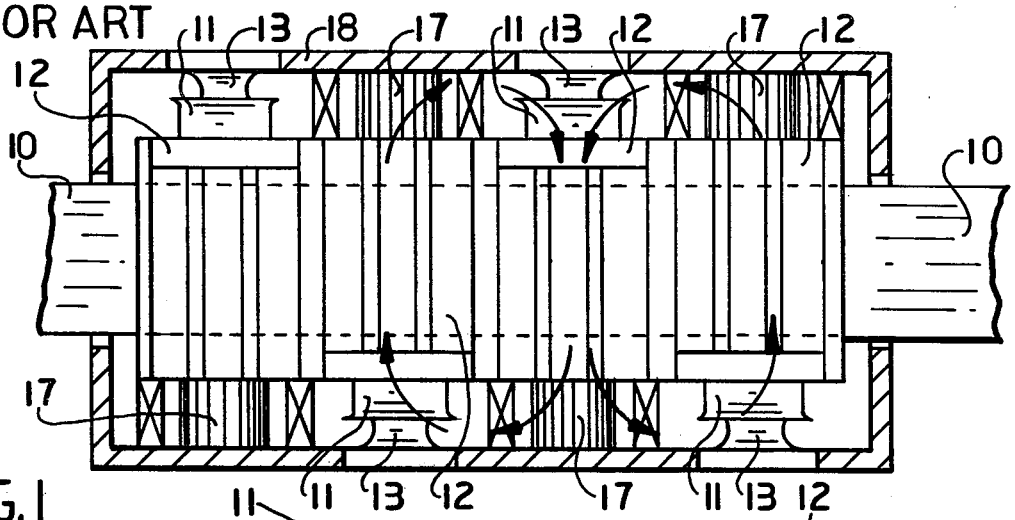
FIG. 1 is a horizontal sectional view, in part elevation, of the prior art drying apparatus of the type described in German Laid Open Pat. No. 1,064,464.

Referring now to the drying apparatus shown in FIG. 1, which represents the prior art, a web of material 10 is shown being fed between the jet nozzle elements 12 which are alternately positioned on opposite sides of web 10. Blowers 13 are arranged alternately at the right and left side of the web of material opposite each of the jet nozzles 12. The flow of the treatment medium is shown by arrows in FIG. 1. It can be seen that the treatment medium is fed by blowers 13 through inlet openings 11 and into jet nozzle elements 12. So-called "discharge spaces" are provided between the jet fingers through which the treatment medium flows off from the surface of web 10 material. The treatment medium is subsequently sucked up by blower 13 of the adjacent jet nozzle element 12. The treatment medium is again fed through the inlet openings 11 and bach through the jet fingers, etc. Heating elements and lint filters are positioned in front of blowers 13, whereby lint which is removed from web 10 is caught by the lint filter, so as to prevent a blocking of the heating register or air intake for the heating elements. One will recognize that in the shown embodiment of the drying apparatus, four heating elements are required for each drying field taking into consideration that the shown treatment cycle progresses clockwise in the moving direction of the web as well as in a counterclockwise direction as a result of the action by the lower heating elements.

Figure 2:
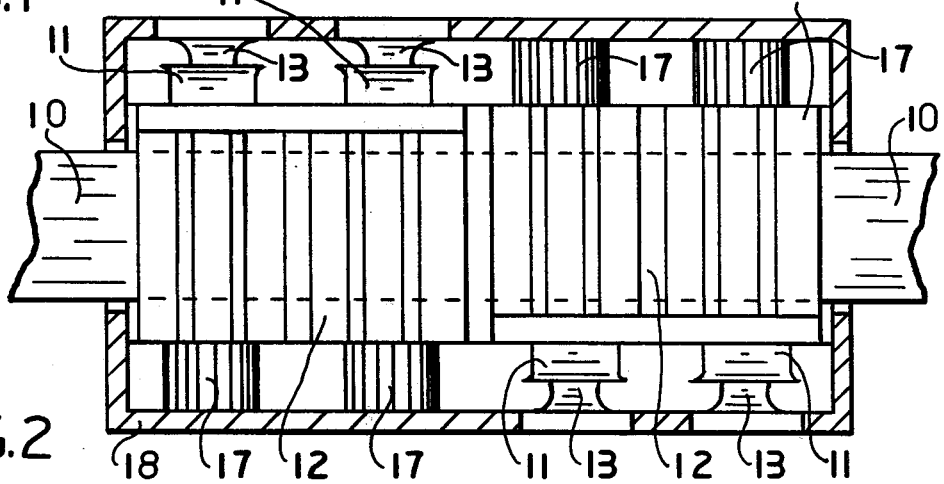
FIG. 2 is a horizontal sectional view, in part elevation, of the drying apparatus embodying the present invention, showing a jet element arrangement comparable to that of FIG. 1.

In the drying apparatus of FIG. 2, which is constructed in the same manner as the drying apparatus shown in FIG. 1, jet nozzle elements 12 with inlet openings 11 and blowers 13 are mounted in housing 18. However, it will be easily recognized that a slight change is made, because the blowers 13 are offset in pairs at each side of web 10. No overlapping of the treatment flow by two adjacent jet nozzle elements 12 is provided for the adjacent fields. This is advantageous in that the individual fields always have a closed circulatory system and can be supplied with different temperatures, as a result of which, an improved adjustment of the treatment temperature is made possible so as to meet different treatment requirements along the moving direction of the web of material. With this arrangement, it is possible to employ for each field only one burner, so that the capacity of the burners is increased four times, in contrast to the embodiment shown in FIG. 1. This naturally increases the effectiveness of the device and the operational safety by providing a lesser number of control elements, namely, only one, instead of four burners.

Figure 3:
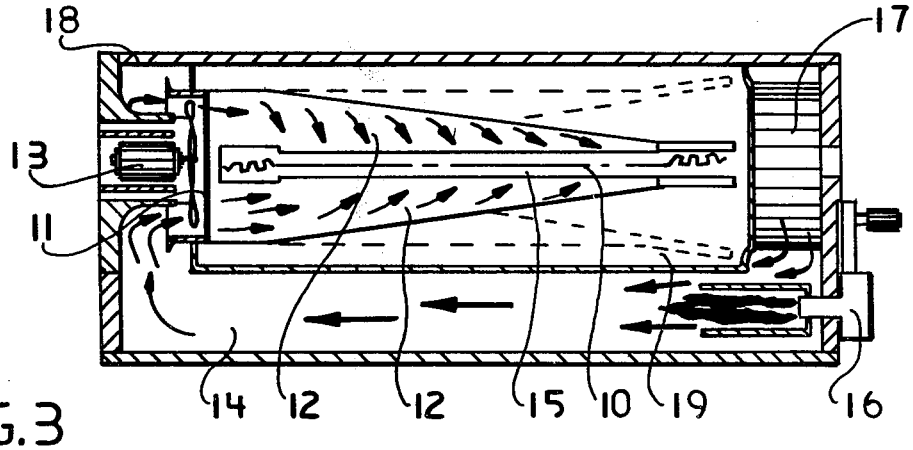
FIG. 3 is a vertical-sectional view through the drying apparatus shown in FIG. 2.

The vertical sectional view of FIG. 3 shows the structure of the inventive device. It can be seen that a blower 13 is positioned on the left side of housing 18. The treatment medium flows through blower 13 into jet nozzle element 12 which is provided with upper and lower jet fingers. The treatment medium flows in the direction of the arrows from the jet fingers into first segment 15 of a treatment chamber and onto web 10 which is fed therethrough. The treatment medium then flows between the jet fingers into discharge segment 19 of the treatment chamber and flows from there through the lint filter 17 disposed in a discharge chamber, which leads directly into return flow chamber 14; the latter of which in accordance with the subject invention is arranged underneath treatment chamber 15. There, the treatment medium is heated again by burner 16 and aspirated by blower 13 and again introduced into jet nozzle element 12. In the illustrated embodiment, lint filter 17 is shown as an annular filter.

While the present invention provides a more economical and simpler device, due to the lesser amount of heating elements required, a further advantage is obtained by the illustrated embodiment because the treatment medium is fed vertically and not horizontally as shown in FIG. 1, as a result of which the free space beneath the treatment chamber may be used for the return flow of the medium. Consequently, as previously mentioned, it is possible to provide clear separation between the individual drying fields, so as to permit an optimum adjustment of the treatment requirements along the direction of the moving web.

The extremely long feeding path for the treatment medium into the return chamber 14 also permits finer control of circulating treatment medium, as a result of which the inventive device is better suited for meeting the different operational requirements than any other drying apparatus heretofore employed.

While only one embodiment of the present invention was shown and described, it will be obvious to those persons of ordinary skill in the art that many changes and modifications may be made thereunto without departing from the spirit and scope of the invention.

What is claimed is:

1. In a device for drying relatively wide textile webs, and the like, by means of a circulating, heated gas-like medium of the type including a drying chamber housing which defines a treatment chamber through which the web is passed horizontally therethrough, and a plurality of jet nozzle elements, each of which has an inlet opening for charging the treatment chamber with said treatment medium and a pair of upper and lower jet fingers which are symmetrically arranged relative to the web and extend over the total width thereof, so as to permit blowing of the treatment medium through the fingers and laterally across the upper and lower surfaces of the web, the inlet openings of the jet finger elements being alternately arranged on opposite lateral sides of the web, so as to ensure an even distribution of the treatment medium over the total face of the web, the improvement comprising:

said jet nozzle elements being arranged consecutively in alternate adjacent pairs, with one pair of jet nozzle elements arranged with their inlet openings disposed on one side of the web and the next adjacent and following pair of jet nozzle elements arranged with their inlet openings on the other side of the web, and wherein said housing defines a separate discharge chamber disposed downstream of and opposite each of the inlet openings through which the medium flows from the treatment chamber, said discharge chamber leading to a common return flow chamber for each of said pair of jet nozzle elements, which is disposed directly beneath said treatment chamber and which leads the treatment medium discharged to said chamber in an opposite direction, directly back to said inlet openings, so as to provide a substantially closed circulatory path for each of said pair of jet nozzle elements, said housing having a heating element disposed in said common return chamber, which serves each pair of jet nozzle elements.

2. The device according to claim 1, wherein a lint filter is mounted in said discharge chamber.

3. The device according to claim 2, wherein said lint filter is an annular filter.

4. The device according to claim 1, wherein said heating elements are disposed in open burn chambers, and wherein only one burn chamber is provided in each of the common-return chambers for each pair of adjacent jet nozzle elements.

* * * * *